US007758702B1

(12) United States Patent
Huffman

(10) Patent No.: US 7,758,702 B1
(45) Date of Patent: Jul. 20, 2010

(54) EXTRACTION CLEANING WITH SURFACE HEATING

(75) Inventor: Eric C. Huffman, Lowell, MI (US)

(73) Assignee: BISSELL Homecare Inc., Grand Rapids, MI (US)

( * ) Notice: Subject to any disclaimer, the term of this patent is extended or adjusted under 35 U.S.C. 154(b) by 1206 days.

(21) Appl. No.: 11/275,468

(22) Filed: Jan. 6, 2006

Related U.S. Application Data

(60) Provisional application No. 60/593,359, filed on Jan. 7, 2005.

(51) Int. Cl.
*A47L 5/00* (2006.01)
*E01H 1/08* (2006.01)

(52) U.S. Cl. ..... 134/21; 15/320; 15/340.1; 15/340.3; 15/383; 15/50.1

(58) Field of Classification Search ..... 15/320, 15/340.1, 340.3, 383, 49.1, 50.1; 134/21; *A47L 5/00, A47L 7/00; E01H 1/08*
See application file for complete search history.

(56) References Cited

U.S. PATENT DOCUMENTS

| | | | | |
|---|---|---|---|---|
| 5,237,720 | A | 8/1993 | Blase et al. | |
| 5,309,593 | A * | 5/1994 | Yonehara | 15/92 |
| 5,587,021 | A * | 12/1996 | Hoersch et al. | 134/1 |
| 6,131,237 | A | 10/2000 | Kasper et al. | |
| 6,457,206 | B1 * | 10/2002 | Judson | 15/320 |
| 6,560,817 | B2 * | 5/2003 | Deiterman et al. | 15/320 |

* cited by examiner

*Primary Examiner*—David A Redding
(74) *Attorney, Agent, or Firm*—McGarry Bair PC

(57) ABSTRACT

Extraction surface cleaning wherein a cleaning liquid is applied to a surface to be cleaned and extracted to remove the soiled cleaning fluid from the surface, and the surface is heated prior to or concurrent with the application of the cleaning fluid to the surface. A method and apparatus are disclosed.

19 Claims, 5 Drawing Sheets

EXTRACTION CLEANING WITH SURFACE HEATING

CROSS-REFERENCE TO RELATED APPLICATION

This application claims the benefit of U.S. provisional application Ser. No. 60/593,359, filed Jan. 7, 2005, which is incorporated herein in its entirety.

BACKGROUND OF THE INVENTION

1. Field of the Invention

This invention relates to extraction cleaning. In one of its aspects, the invention relates to an upright extraction cleaning machine with enhanced surface cleaning. In another of its aspects, the invention relates to an extraction cleaning machine with a heated cleaning solution. In yet another of its aspect, the invention relates to a method of surface cleaning with surface heating.

2. Description of the Related Art

Upright extraction cleaning machines have been used for removing dirt from surfaces such as carpeting and bare floors. The known extraction cleaning machines can be in the form of a canister-type unit, as disclosed in U.S. Pat. No. 5,237,720 to Blase et al., or an upright unit, as disclosed in U.S. Pat. No. 6,131,237 to Kasper, et al.

Either type of unit contains a fluid delivery system for depositing a quantity of cleaning solution on the surface to be cleaned. The cleaning solution dissolves the dirt, removes the dirt from the surface, and places the dirt in suspension, which aids in the vacuum removal of the dirt from the surface. The solubility of the dirt in the cleaning solution can be increased by heating the cleaning solution. The cleaning solution is typically heated with an in-line heater or an immersion heater in a cleaning solution tank prior to being deposited on the surface to be cleaned.

The heated cleaning solution tends to cool during the time that the cleaning solution travels from the in-line heater to the surface to be cleaned. The heating solution is further cooled upon contact with the surface. Additional cooling can take place between the time that the heating solution contacts the surface and the time that the solution and dirt is to be extracted from the surface. This loss of heat can reduce the effectiveness of the cleaning solution.

SUMMARY OF THE INVENTION

A portable cleaning apparatus comprises a module for movement along a surface to be cleaned, the module having a cleaning liquid dispensing system for applying a cleaning liquid to the surface, and a suction nozzle associated with the base module. According to the invention, a heating element is associated with the base module for heating the surface to be cleaned to enhance cleaning effectiveness.

In one embodiment of the invention, the heating element is adapted to heat the surface concurrent with the application of the cleaning liquid.

In another embodiment of the invention, the heating element is located at a forward portion of the module.

In another embodiment, the heating element comprises a rectilinear body extending laterally across the base module.

In another embodiment, the heating element comprises a plurality of teeth that are adapted to project into the carpet.

In yet another embodiment, the heating element comprises a roller. In another embodiment, the heating element is heated by electricity, heated air, or heated liquid.

Further according to the invention, a method for cleaning a surface comprises the steps of heating the surface; applying a cleaning fluid to the surface; entraining dirt and debris in the cleaning fluid; extracting the cleaning fluid with the entrained dirt and debris from the surface; and collecting the extracted cleaning fluid with the entrained dirt and debris.

In one embodiment of the invention, the heating step takes place prior to the step of applying the cleaning liquid to the surface to raise the heat content of the cleaning fluid and enhance the effectiveness of the cleaning of the surface.

The heating step can take place with a number of different heating sources, including electricity, heated air, or heated liquid.

In one embodiment of the invention, the step of applying the cleaning fluid includes the step of heating the cleaning fluid prior to applying the cleaning fluid to the surface to be cleaned.

In another embodiment of the invention, the steps of heating the surface and heating the cleaning fluid are simultaneously performed by the same heating element.

Preferably, the cleaning solution is heated between the applying and the entraining steps, for example, between the times that the cleaning fluid is dispensed toward the surface and it reaches the surface.

The cleaning solution is typically applied to the surface to be cleaned subsequent to the heating step to raise the temperature of the cleaning solution that is applied to the surface. In another embodiment of the invention, the cleaning fluid can be heated between the applying and the entraining steps. In yet another embodiment of the invention, the cleaning fluid can be heated prior to the step of applying the cleaning fluid to the surface to be cleaned, in which case it is further heated when it has been applied to the surface to be cleaned or otherwise during application step.

DESCRIPTION OF AN EMBODIMENT OF THE INVENTION

Figure 1:
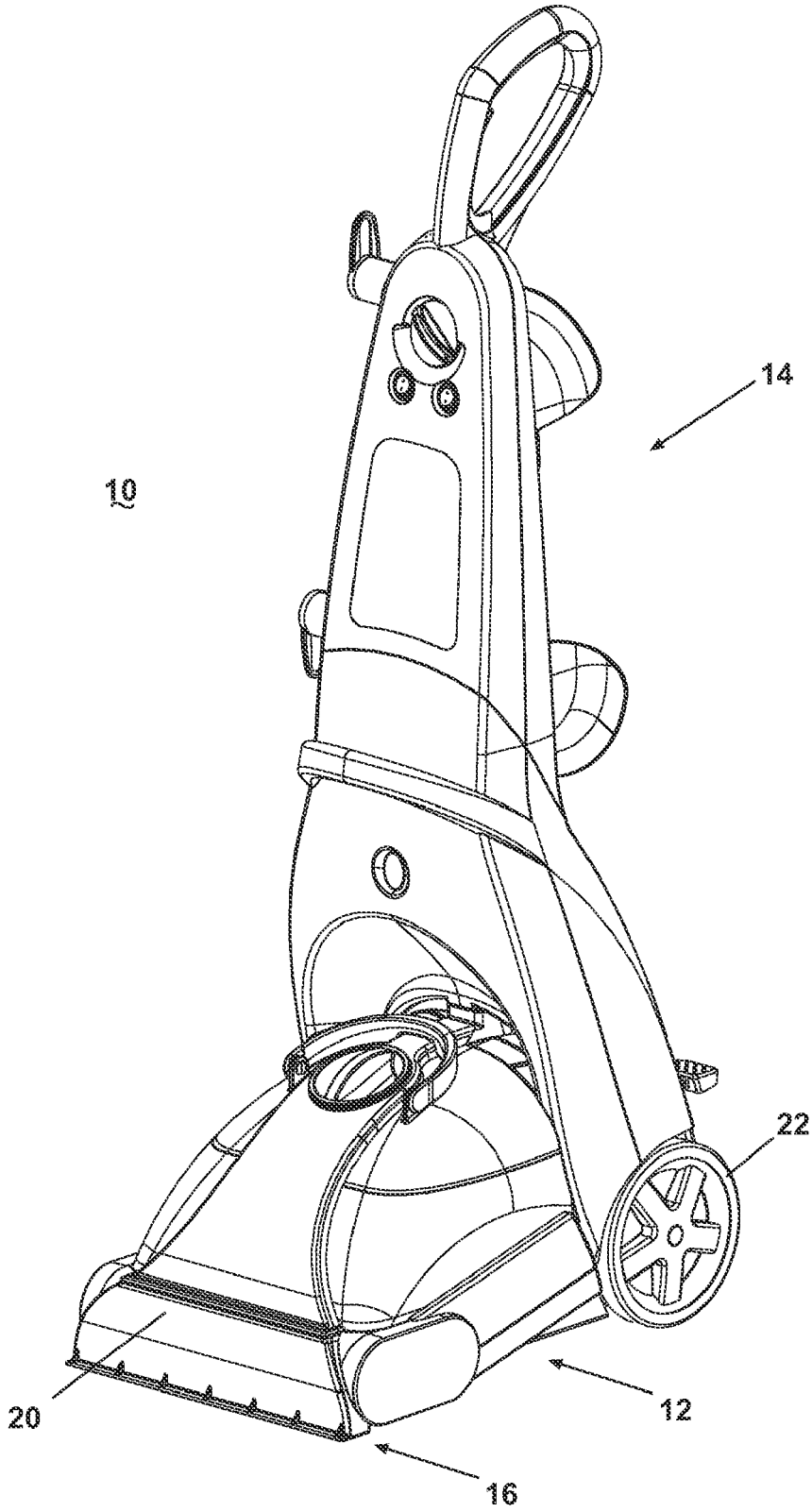
FIG. 1 is a perspective view of an upright extraction cleaning machine according to the invention.

Referring now to the drawings and to FIG. 1 in particular, an embodiment of the invention is illustrated comprising an extraction cleaning machine 10 having a portable surface cleaning apparatus including a base module 12 adapted with wheels 22 to roll across a surface to be cleaned, and an upright handle assembly 14 pivotally mounted to a rear portion of the base module 12. The invention is described and illustrated herein with respect to an embodiment comprising an upright extraction cleaning machine, although the invention can also be utilized in a canister-type cleaning machine. The upright extraction cleaning machine 10 is a generally well-known device comprising several of the features and operations described in U.S. Pat. No. 6,131,237 to Kasper, et al., which is incorporated herein by reference in its entirety. Such well-known features and operations will not be described in detail herein, except as otherwise necessary for a complete understanding of the invention.

Figure 2:
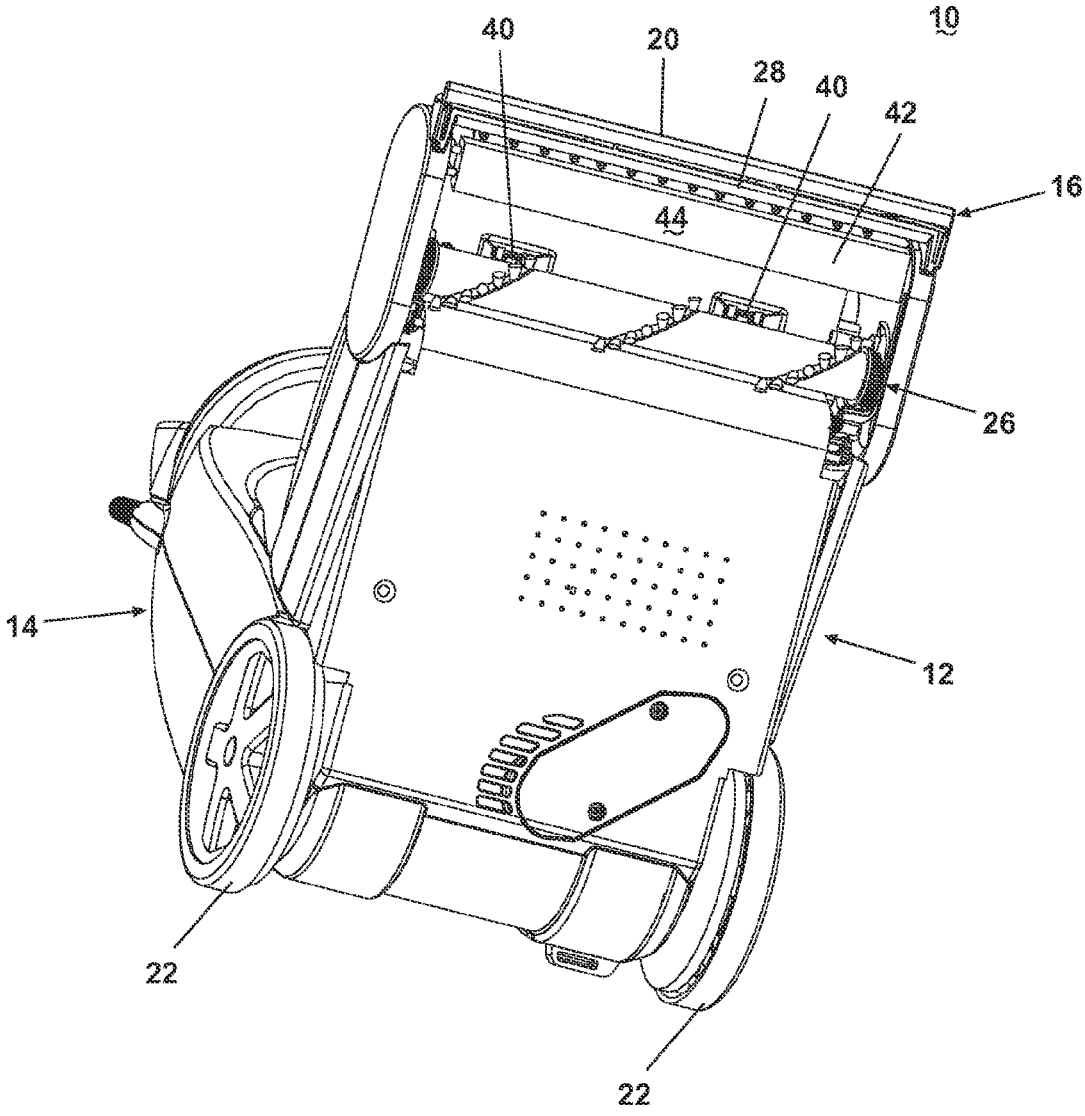
FIG. 2 is a perspective view of an underside of the upright extraction cleaning machine of FIG. 1 illustrating a heating element for heating the surface being cleaned.

As illustrated in FIGS. 1 and 2, the base module 12 includes a housing 20 having a front portion 16 and a base wall 30. The housing 20 forms an enclosure for a motor 24 operating a well-known liquid vacuum system (not shown), an agitation assembly 26, a liquid delivery system comprising a pair of outlet dispensers 40 for applying liquid to the surface to be cleaned, liquid reservoirs, and the like.

Figure 3:
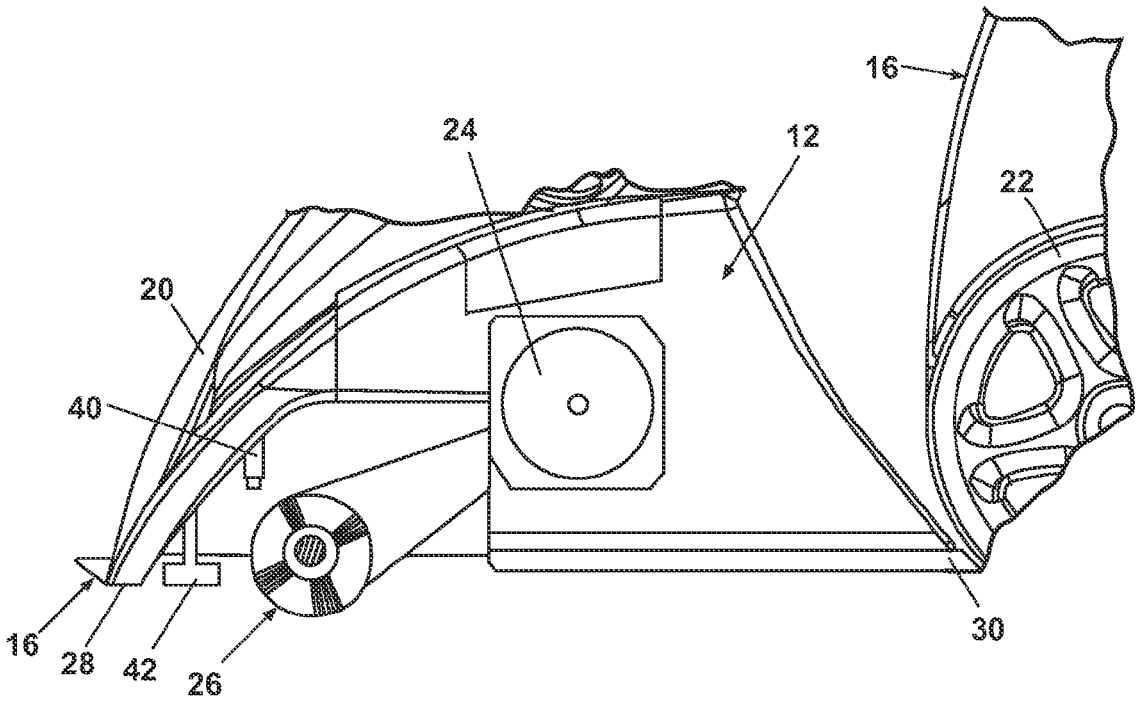
FIG. 3 is a partial sectional side view of the upright extraction cleaning machine of FIG. 1 illustrating the location of the heating element.
Figure 4:
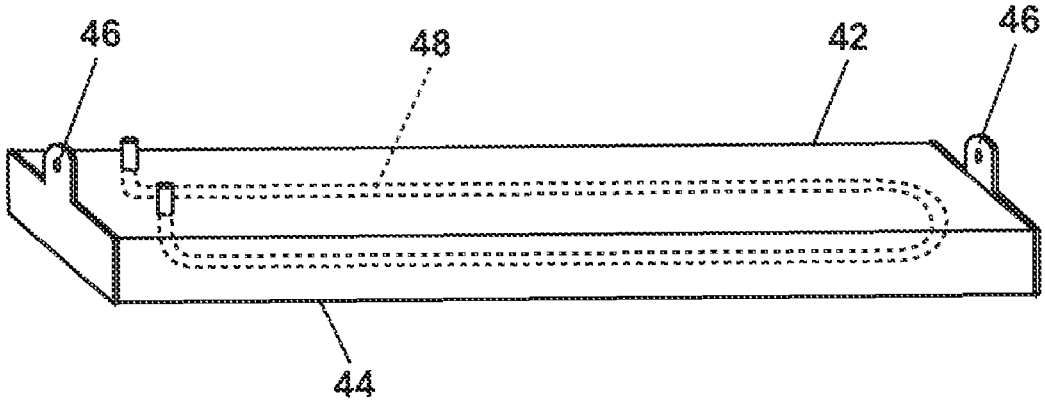
FIG. 4 is a perspective view of the heating element of the upright extraction cleaning machine illustrated in FIGS. 1-3.

As illustrated also in FIG. 3, the vacuum system comprises a suction nozzle 28 at the front portion 16 of the housing 20 adapted for vacuum removal of liquid from the carpet. Intermediate the suction nozzle 28 and the agitation assembly 26 are the outlet dispensers 40. Thus, cleaning liquid can be discharged through the element nozzles 40 onto the carpet during forward travel of the extraction cleaning machine 10, to be scrubbed by the agitation assembly 26. Rearward travel of the extraction cleaning machine 10 will result in the cleaning liquid being extracted through the suction nozzle 28 in a well-known manner.

As illustrated in FIGS. 2 and 3, a heating element comprising a heater plate 42 is mounted to the housing 20 intermediate the outlet dispensers 40 and the suction nozzle 28. The heater plate 42 is a generally rectilinear, planar body adapted to extend laterally across the full width of the extraction cleaning machine 10, and is adapted with a suitable means for attaching the heater plate 42 to the housing 20, such as fastening ears 46 adapted for receiving a threaded fastener therethrough. The heater plate 42 can also be removably attached to the housing 20, such as through a receptacle mounted to the housing 20 and adapted to hold the heater plate 42 therein through a snap-fit connection, an interference fit connection, or other suitable apparatus (not shown) for removably joining the heater plate 42 to the housing 20. The heater plate 42 is attached to the housing 20 so that a lower contact surface 44 is in contact with the surface to be cleaned during the use of the extraction cleaning machine 10. Preferably, the heater plate 42 is fabricated of cast aluminum, although other thermally conductive materials can be used.

The heater plate 42 is adapted with a suitable heating element, such as a well-known calorimeter rod (known as a calrod) element 48, which is electrically interconnected with the power supply for the extraction cleaning machine 10. The calrod element 48 can also be electrically connected with a suitable control mechanism (not shown) for selectively activating and deactivating the calrod element 48, and for adjusting the temperature of the heater plate 42 to accommodate surfaces fabricated of different materials, such as wool, nylon, tile, wood, and the like. Alternatively, the heater plate 42 can be heated through a foil-type heater affixed to the lower contact surface 44 and electrically interconnected with the power supply for the extraction cleaning machine 10. The foil-type heater can also be electrically connected with a suitable on-off control mechanism and temperature controls.

The heater plate 42 can also be heated by a heated medium, such as air or water, which is circulated through the heater plate 42. A suitable air or water heater would heat the medium to a selected temperature. Thus, an in-line water heater can be used to heat the water and a resistance-type heater can be used to heat the air. Heated air can be directed to a wetted surface after passing through the heater plate 42 to assist in drying of the surface after completion of the cleaning operation. Other heating methods for the heater plate 42 can include chemical heating, resistance heating, and the like. The heater plate 42 can be electrically or fluidly connected to suitable controls, heating elements, fluid lines, and duct work for selectively delivering electrical power, liquid, and/or air to and from the heater plate 42.

Figure 5:
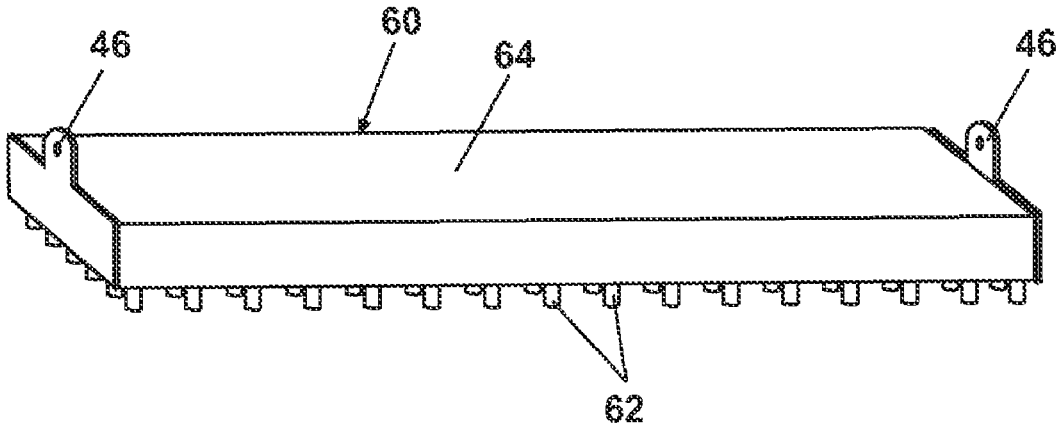
FIG. 5 is a perspective view of a second embodiment of the heating element according to the invention.

FIG. 5 illustrates an embodiment of the heater plate 60 in which an array of regularly-spaced teeth 62 extends orthogonally away from a lower surface of a rectilinear plate body 64. The teeth 62 are adapted for insertion into a carpeted surface between the carpet fibers, similar to a comb or a rake, in order to facilitate heating the carpet to a greater depth which facilitates deeper soil removal and cleaning, and maintains the carpet at a higher temperature for a longer period of time. The configuration of the teeth 62, such as the number and spacing, the length, and the cross-sectional area, can be selected based upon characteristics of the carpet to be cleaned, such as thickness, tightness of the weave, length of the nap, and the like.

The heater plate 60 illustrated in FIG. 5 can be heated through one of the aforementioned methods. However, heating of the teeth 62 can be facilitated through the use of heated air or water which is circulated into or through the teeth 62 as well as the plate body 64, rather than a heating element which directly heats only the plate body 64.

The heater plate 42 can also be provided with grooves, rounded protrusions, and the like, over the contact surface 44 to facilitate heating a carpet, a rug, or a similar textile below the surface. The heater plate 42 can be adapted with an automatic on-off switch that turns the heater off when the contact surface 44 is lifted away from the surface to be cleaned, thereby protecting a user against burns caused by contact with the heated contact surface 44.

Figure 6:
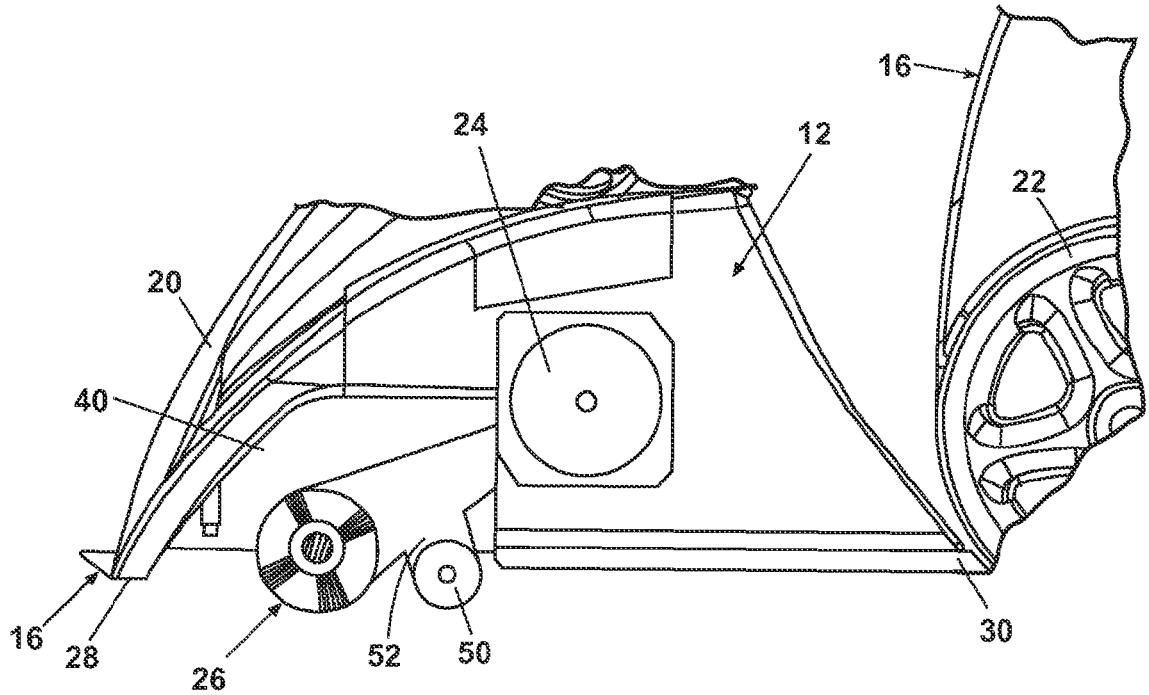
FIG. 6 is a partial sectional side view of a third embodiment of the heating element according to the invention.

FIG. 6 illustrates a heated roller 50 to heat the surface to be cleaned. The heated roller 50 is connected to the agitation assembly 26 through a support element 52, such as an arm or support frame. The heated roller 50 can move vertically with vertical movement of the agitation assembly 26. In FIG. 6, the heated roller 50 is shown rearward of the agitation assembly 26. However, the heated roller 50 can also be located forward of the agitation assembly 26 and rearward of the outlet dispensers 40. Similarly, the heater plate 42 can be located rearward of the agitation assembly 26. Alternatively, a pair of heater plates 42 or heated rollers 50 can be utilized, on either side of the agitation assembly 26 or the outlet dispensers 40, in order to provide increased heating of the surface to be cleaned.

It is anticipated that the liquid delivery system can utilize an in-line heater for heating the cleaning liquid, with the heater plates 42 or heated rollers 50 utilized solely to heat and dry the surface to be cleaned. However, the liquid delivery system can be configured so that the outlet nozzles 40 deliver cleaning liquid to the heater plate 42 or heated roller 50 in order to heat the cleaning liquid prior to application of the cleaning liquid to the surface. With such a configuration, the in-line heater can be eliminated, or can be utilized in a first step of a two-step cleaning liquid heating process.

Referring again to FIG. 3, travel of the extraction cleaning machine 10 in a forward direction results in the heater plate 42 first heating the surface to be cleaned forward of the cleaning liquid outlet nozzles 40 and the agitation assembly 26. Consequently, cleaning liquid discharged from the outlet dispensers 40 is discharged onto a heated surface, thereby maintaining or raising the temperature of the cleaning liquid and enhancing its effectiveness. The agitation assembly 26 can then immediately scrub the heated surface and cleaning liquid, facilitating the lifting and suspension of dirt from the surface. Travel of the extraction cleaning machine 10 in a rearward direction results in the cleaning liquid and dirt being extracted from the surface through the suction nozzle 28. Movement of the extraction cleaning machine 10 again in a forward direction and a rearward direction, but without the discharge of liquid from the outlet dispensers 40, results in heating of the surface by the heater plate 42, which also facilitates drying of the surface.

The use of a heater plate in contact with carpet being cleaned can facilitate the removal of dirt from the surface to be cleaned by raising the temperature of cleaning fluid applied to the surface and maintaining the high temperature of the cleaning fluid and of the surface for a longer period of time than available using conventional extraction cleaners. The heater plate can be configured to accommodate surfaces having different thicknesses, materials, and weaves, and can be utilized to heat not only the surface to be cleaned but the cleaning liquid as well. After application and removal of the cleaning liquid, the heater plate can be used to heat the surface to facilitate drying, and shorten the time until the surface can be again placed in use.

With a canister-type cleaning machine having a canister base module and a wand, the liquid vacuum system, a cleaning fluid reservoir, controls, and power system components can be housed in the canister. The agitation assembly 26, the suction nozzle 28, the outlet dispensers 40, and the heating element 42, 50, 60 can be housed in the wand head in a configuration similar to that described and illustrated for the upright extraction cleaning machine 10. Suitable supply lines extending from the canister to the wand head provide electrical power, heated air, or heated liquid to heat the heating element 42, 50, 60.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

The invention claimed is:

1. A portable surface cleaning apparatus, comprising:

a module for movement along a surface to be cleaned and comprising a cleaning liquid dispensing system for applying a cleaning liquid to the surface to be cleaned;

a rotating brush for scrubbing the surface to be cleaned while the cleaning liquid is on the surface;

a suction nozzle adapted to contact the surface to be cleaned;

a vacuum source in fluid communication with the suction nozzle for removal of soiled liquid from the surface; and a heating element associated with the module and adjacent the rotating brush;

wherein the heating element is adapted for contact with and conductive heating of the surface to enhance the cleaning effectiveness of the cleaning liquid subsequently applied on the surface.

2. The portable surface cleaning apparatus of claim 1 wherein the heating element is located at a forward portion of the module.

3. The portable surface cleaning apparatus of claim 1 wherein the heating element comprises a rectilinear body extending laterally across the module.

4. The portable surface cleaning apparatus of claim 1 wherein the heating element comprises a plurality of teeth that are adapted to extend into the surface to be cleaned.

5. The portable surface cleaning apparatus of claim 1 wherein the heating element comprises a roller.

6. The portable surface cleaning apparatus of claim 1 wherein the heating element is heated by one of electricity, heated air, or heated liquid.

7. The portable surface cleaning apparatus of claim 1 wherein the cleaning liquid dispensing system delivers the cleaning liquid to the heating element for heating of the cleaning liquid prior to applying the cleaning liquid to the surface to be cleaned.

8. The portable surface cleaning apparatus of claim 1 wherein the heating element is adapted to heat the surface prior to application of the cleaning liquid thereto to thereby raise the heat content of the cleaning liquid when it is applied to the surface.

9. The portable surface cleaning apparatus of claim 1 wherein the module further includes a chamber adjacent the suction nozzle, and the chamber encloses the rotating brush, a portion of the liquid dispensing system, and the heating element.

10. A method for cleaning a surface comprising the steps of:

heating by conduction the surface to be cleaned;

heating a cleaning liquid prior to applying the cleaning liquid to the surface;

simultaneously heating the surface and the cleaning liquid by a single heating element;

applying the cleaning liquid to the heated surface;

entraining dirt and debris in the cleaning liquid;

extracting the cleaning liquid with the entrained dirt and debris from the surface; and collecting the extracted cleaning liquid with the entrained dirt and debris.

11. A method for cleaning a surface according to claim 10 wherein the heating step takes place by one of electricity, heated air, or heated liquid.

12. A method for cleaning a surface according to claim 10, and further comprising the step of heating the cleaning liquid between the applying and the entraining steps.

13. A method for cleaning a surface according to claim 12, and further comprising the step of heating the cleaning liquid subsequent to the step of applying the cleaning liquid to the surface to be cleaned.

14. A method for cleaning a surface comprising the steps of:

providing a portable module for movement along the surface to be cleaned comprising a cleaning liquid dispensing system and a heating element associated with the module;

heating by conduction the surface to be cleaned using the heating element;

applying a cleaning liquid to the heated surface using the liquid dispensing system;

entraining dirt and debris in the cleaning liquid;

extracting the cleaning liquid with the entrained dirt and debris from the surface; and collecting the extracted cleaning liquid with the entrained dirt and debris.

15. A method for cleaning a surface according to claim 14 wherein the step of applying the cleaning liquid includes the step of heating the cleaning liquid prior to applying the cleaning liquid to the surface to be cleaned.

16. A method for cleaning a surface according to claim 15 wherein the steps of heating the surface and heating the cleaning liquid are simultaneously performed by the same heating element.

17. A method for cleaning a surface according to claim 14, and further comprising the step of heating the cleaning liquid prior to the step of applying the cleaning liquid to the surface to be cleaned.

18. A portable surface cleaning apparatus, comprising:

a module for movement along a surface to be cleaned and comprising a cleaning liquid dispensing system for applying a cleaning fluid to the surface to be cleaned;

a suction nozzle adapted to contact the surface to be cleaned; and a vacuum source in fluid communication with the suction nozzle for removal of soiled liquid from the surface; and a heating element associated with the module for heating the surface to be cleaned to enhance cleaning effectiveness, the heating element comprising a plurality of teeth adapted to extend into the surface to be cleaned.

19. A portable surface cleaning apparatus, comprising:

a module for movement along a surface to be cleaned and comprising a cleaning liquid dispensing system for applying a cleaning fluid to the surface to be cleaned;

a suction nozzle adapted to contact the surface to be cleaned; and a vacuum source in fluid communication with the suction nozzle for removal of soiled liquid from the surface; and a heating element comprising a roller, associated with the module for heating the surface to be cleaned to enhance cleaning effectiveness.

* * * * *